US008720795B2

(12) United States Patent
Sato et al.

(10) Patent No.: US 8,720,795 B2
(45) Date of Patent: May 13, 2014

(54) SHOWER DEVICE

(75) Inventors: Minoru Sato, Fukuoka-ken (JP); Yutaka Aihara, Fukuoka-ken (JP); Minami Okamoto, Fukuoka-ken (JP); Kiyotake Ukigai, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 1038 days.

(21) Appl. No.: 12/677,156

(22) PCT Filed: Oct. 6, 2008

(86) PCT No.: PCT/JP2008/002812
§ 371 (c)(1),
(2), (4) Date: May 10, 2010

(87) PCT Pub. No.: WO2009/047889
PCT Pub. Date: Apr. 16, 2009

(65) Prior Publication Data

US 2010/0230512 A1 Sep. 16, 2010

(30) Foreign Application Priority Data

Oct. 10, 2007 (JP) ..... 2007-264984
Sep. 19, 2008 (JP) ..... 2008-241513

(51) Int. Cl.
*B05B 3/02* (2006.01)

(52) U.S. Cl.
USPC ..... 239/214.15; 239/214.19; 239/222; 239/222.13; 239/222.21; 239/237; 239/240; 239/380; 239/463; 239/488; 239/558

(58) Field of Classification Search
USPC ..... 239/214.15, 214.19, 222, 222.11, 239/222.12, 222.17, 222.21, 225.1, 237, 239/240, 241, 380, 381, 222.13, 227, 463, 239/499, 504, 548, 556, 558
See application file for complete search history.

(56) References Cited

U.S. PATENT DOCUMENTS 5,248,092 A * 9/1993 Rankin ..... 239/222
5,704,547 A * 1/1998 Golan et al. ..... 239/240
6,360,965 B1 * 3/2002 Clearman et al. ..... 239/214.15

FOREIGN PATENT DOCUMENTS

JP 61-263663 A 11/1986

(Continued)

OTHER PUBLICATIONS

International Search Report for PCT/JP2008/002812 dated Jan. 6, 2009.

*Primary Examiner* — Steven J Ganey
(74) *Attorney, Agent, or Firm* — Pearne & Gordon LLP

(57) ABSTRACT

Providing a flush bowl capable of discharging a planar shower-like water discharge flow in a wide range while changing the water discharge trajectory is directed. The shower device according to an embodiment of the invention is a shower device including: a water discharger including a plurality of water discharge ports; a rotator including a channel at its center; a coupling section coupling the inside of the water discharger to the channel of the rotator; a receiving section receiving the rotator; a driving mechanism configured to rotate and revolve the rotator in the receiving section; and a decelerating section provided inside the water discharger. The plurality of water discharge ports is provided asymmetrically with respect to a central axis of the rotator, or discontinuously in a peripheral direction, the water discharger is configured to rotate and revolve by rotation and revolution of the rotator caused by the driving mechanism, the plurality of water discharge ports is configured to cause rotational trajectories of water discharged from the water discharge ports to undergo a periodic rotary motion associated with the rotation of the rotator, the decelerating section has an area larger than a cross-sectional area of the coupling section, and the water discharge ports have a smaller total cross-sectional area than the decelerating section so as to accelerate water decelerated by the decelerating section.

15 Claims, 6 Drawing Sheets

(56) References Cited

FOREIGN PATENT DOCUMENTS

| | | | |
|---|---|---|---|
| JP | 2003-304980 | A | 10/2003 |
| JP | 3518542 | B2 | 4/2004 |
| JP | 2005-118761 | A | 5/2005 |
| JP | 2007-054737 | A | 3/2007 |
| WO | 02055795 | A1 | 7/2002 |

* cited by examiner

AA-AA CROSS SECTION

SHOWER DEVICE

TECHNICAL FIELD

Aspects of the invention relate generally to a shower device which discharges a shower-like water discharge flow while changing the water discharge direction (water discharge trajectory).

BACKGROUND ART

Conventionally, a water discharge device is known, as disclosed in Japanese Patent No. 3518542, which is caused to discharge water while its nozzle undergoes wobbling revolution and rotation by a swirling flow formed in a swirling chamber where the nozzle is received.

However, in such a water discharge device, a linear (point-like) water discharge flow is discharged from one nozzle hole, and the area of a human body or the like hit by the water discharge flow is small. Thus, for instance, in shower bathing using the water discharge device, it is difficult to provide bathing comfort for efficiently warming a wide region of the body.

Patent Document 1: Japanese Patent No. 3518542

DISCLOSURE OF INVENTION

This invention is based on the recognition of the above problem, and provides a flush bowl capable of discharging a shower-like water discharge flow planarly in a wide range while changing the water discharge trajectory.

According to an aspect of the invention, there is provided a shower device including: a water discharger including a plurality of water discharge ports; a rotator including a channel at its center; a coupling section coupling the inside of the water discharger to the channel of the rotator; a receiving section receiving the rotator; a driving mechanism configured to rotate and revolve the rotator in the receiving section; and a decelerating section provided inside the water discharger, the plurality of water discharge ports being provided asymmetrically with respect to a central axis of the rotator, or discontinuously in a peripheral direction, the water discharger being configured to rotate and revolve by rotation and revolution of the rotator caused by the driving mechanism, the plurality of water discharge ports being configured to cause rotational trajectories of water discharged from the water discharge ports to undergo a periodic rotary motion associated with the rotation of the rotator, the decelerating section having an area larger than a cross-sectional area of the coupling section, and the water discharge ports having a smaller total cross-sectional area than the decelerating section so as to accelerate water decelerated by the decelerating section.

BEST MODE FOR CARRYING OUT THE INVENTION

An embodiment of the invention will now be described with reference to the drawings.

Figure 1:
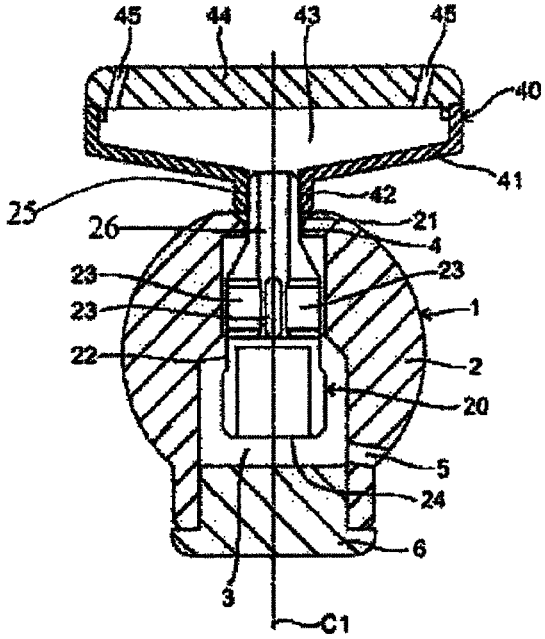
FIG. 1 is a schematic cross-sectional view of a shower device according to an example of the invention.

FIG. 1 is a schematic cross-sectional view of a shower device according to an embodiment of the invention.

The shower device according to this embodiment primarily includes a guiding member 1, a rotator 20, and a water discharger 40. With regard to the flow of water in this specification, the water discharge side of the shower device is defined as downstream, and the water supply side from outside to the shower device is defined upstream.

The guiding member 1 has a structure in which a through hole is formed inside a spherical section 2. A swirling chamber (receiving section) 3 extending in a diameter direction of the spherical section 2 is formed inside the spherical section 2. An opening 4 communicating with the inside and outside of the swirling chamber (receiving section) 3 is provided at one axial end portion of the swirling chamber (receiving section) 3. The inner diameter dimension of the opening 4 is smaller than the inner diameter dimension of the swirling chamber (receiving section) 3, and the central axis of the opening 4 is matched with the central axis of the swirling chamber (receiving section) 3. An inflow hole 5 is formed radially outward on the other axial end portion side of the swirling chamber (receiving section) 3. The inflow hole 5 communicates with the inside of the swirling chamber (receiving section) 3 and the outside of the spherical section 2. The water guided from outside the guiding member 1 to the inflow hole 5 flows through the inflow hole 5 into the swirling chamber (receiving section) 3 along the tangential direction and forms a swirling flow of water inside the swirling chamber (receiving section) 3. The opening 4 is opened to the outside of the guiding member 1, and the opening at the other end side of the swirling chamber (receiving section) 3 is closed by a sealing member 6.

The rotator 20 is formed into a generally bottle-like shape having a reduced diameter portion 21 and a large diameter portion 22. The tip side of the reduced diameter portion 21 serves as a coupling section 25 to which a connecting section formed at an inflow port 42 in and upstream of the water discharger 40 is coupled. The outer diameter dimension of the large diameter portion 22 is smaller than the inner diameter dimension of the swirling chamber (receiving section) 3, and the large diameter portion 22 is received inside the swirling chamber (receiving section) 3. The outer diameter dimension of the reduced diameter portion 21 integrally formed with the large diameter portion 22 is smaller than the inner diameter dimension of the opening 4. The reduced diameter portion 21 penetrates through the opening 4, and its tip protrudes outside the spherical section 2. Because the outer diameter dimension of the large diameter portion 22 is larger than the inner diameter dimension of the opening 4, the entirety of the rotator 20 never bounces out of the guiding member 1 as long as the guiding member 1 is closed by the sealing member 6.

As shown in FIG. 1, in the state where the central axes of the rotator 20 and the swirling chamber (receiving section) 3 are matched with each other, a gap is formed between the outer peripheral surface of the reduced diameter portion 21 and the inner wall surface of the opening 4, and a gap is formed also between the outer peripheral surface of the large diameter portion 22 of the rotator 20 and the inner wall surface of the swirling chamber (receiving section) 3. The rotator 20 is not fixed to the guiding member 1, but allowed to undergo free rotation and wobbling revolution including swinging.

Both axial ends of the rotator 20 are opened. The water poured into the rotator 20 from the opening 24 on the large diameter portion 22 side can flow inside the rotator 20 in the axial direction and flow out of the opening on the reduced diameter portion 21 side to the outside of the rotator 20. Furthermore, a plurality of through holes 23 equidistantly and intermittently arranged in the peripheral direction are formed in the peripheral surface (side surface) of the large diameter portion 22 of the rotator 20. The water poured into the swirling chamber (receiving section) 3 can be guided into the rotator 20 also through the through holes 23 and flow out of the tip of the reduced diameter portion 21. The water discharger 40 is formed into a flattened shape having a larger radial dimension than the rotator 20, and its radial center is matched with the central axis C1 of the rotator 20. The water discharger 40 is composed of an inflow port 42 in the water discharger, which has an area larger than the outer diameter cross-sectional area of the tip portion of the reduced diameter portion 21, a funnel-shaped storage member 41, and a sprinkler plate 44. The tip of the reduced diameter portion 21 of the rotator 20 is fitted and fixed inside the inflow port 42 in the water discharger, and thereby the rotator 20 and the water discharger 40 integrally undergo rotation and wobbling revolution including swinging.

A decelerating section (storage chamber) 43 is formed inside the water discharger 40, and the opening at the tip of the reduced diameter portion 21 of the rotator 20 faces the decelerating section (storage chamber) 43. The radial dimension of the decelerating section (storage chamber) 43 is larger than the radial dimension of the rotator 20, and the decelerating section (storage chamber) 43 can temporarily store the water poured out of the tip of the reduced diameter portion 21.

The sprinkler plate 44 is provided like a lid occluding the opening of the decelerating section (storage chamber) 43 on the opposite side from the inflow port 42 in the water discharger. The sprinkler plate 44 is formed into a disc shape having a larger radial dimension than the rotator 20. The sprinkler plate 44 is provided with a plurality of water discharge ports 45 penetrating through its thickness direction. One end of the water discharge port 45 communicates with the decelerating section (storage chamber) 43, and the other end faces outside the water discharger 40.

The plurality of water discharge ports 45 are formed at least in an outer peripheral portion of the sprinkler plate 44 along the peripheral direction. The axial direction of each water discharge port 45 is not parallel to the central axis C1 of the rotator 20, but tilted therefrom. In this embodiment, all the water discharge ports 45 are tilted in the same direction. Hence, the water discharge ports 45 are tilted in an asymmetric relation to the central axis C1 of the rotator 20. That is, the water discharge ports 45 are related to each other so that the tilt direction of the water discharge ports 45 differs between after the sprinkler plate 44 is turned (rotated) 180 degrees about the central axis C1 of the rotator 20 and before it is turned (rotated) 180 degrees.

Next, the operation of the shower device according to this embodiment and the motion (trajectory) of the water discharge flow are described.

Figure 2:
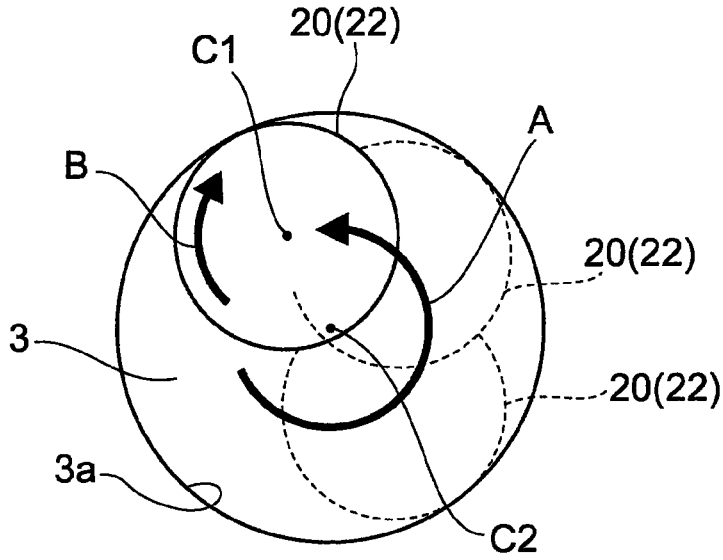
FIG. 2 is a schematic view, in plan view, of a swirling chamber (receiving section) and (a large diameter portion of) a rotator received therein of the shower device according to the example of the invention.
Figure 3:
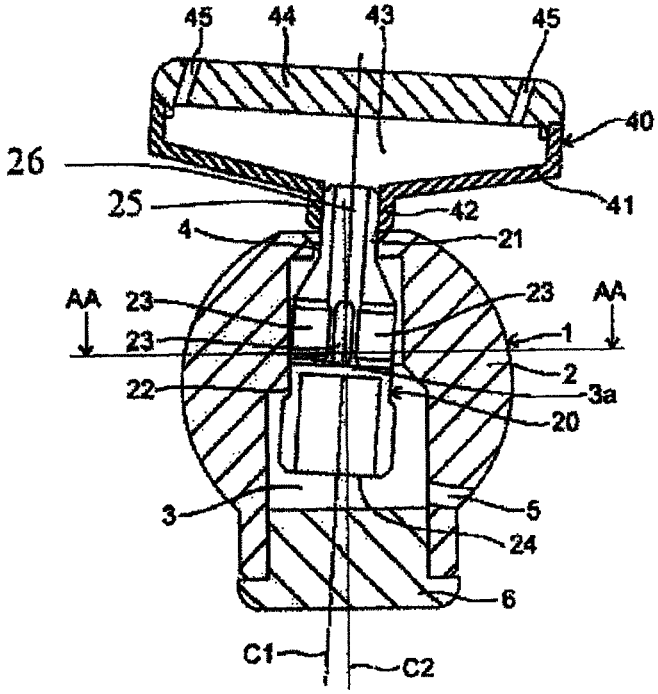
FIG. 3 is a schematic cross-sectional view similar to FIG. 1, and shows a state of the rotator being tilted with respect to the central axis of the swirling chamber (receiving section).

FIG. 2 is a schematic view, in plan view, of the swirling chamber (receiving section) 3 and (the large diameter portion 22 of) the rotator 20 received therein described above, and corresponds to the AA-AA cross section in FIG. 3.

The water (including hot water) guided from a piping or the like, not shown, flows through the inflow hole 5 formed in the guiding member 1 into the swirling chamber (receiving section) 3 having a generally circular cross-sectional shape along the tangential direction. Thus, a flow of water swirling about the central axis C2 of the swirling chamber (receiving section) 3 is formed inside the swirling chamber (receiving section) 3.

In response to the force of the aforementioned swirling flow, (the large diameter portion 22 of) the rotator 20 received inside the swirling chamber (receiving section) 3 revolves about the central axis C2 of the swirling chamber (receiving section) 3 illustratively in the direction shown by arrow A in FIG. 2 while being tilted with respect to the central axis C2 of the swirling chamber (receiving section) 3 as shown in FIG. 3. As shown in FIG. 3, part of the reduced diameter portion 21 of the rotator 20 is in contact with the opening 4, and part of the side surface (peripheral surface) of the large diameter portion 22 is in contact with the guiding surface 3*a* of the swirling chamber (receiving section) 3. This restricts further tilting of the rotator 20 with respect to the central axis C2 of the swirling chamber (receiving section) 3.

In this specification, the revolution of the rotator 20 about the central axis C2 with the rotator 20 tilted with respect to the central axis C2 of the swirling chamber (receiving section) 3 is referred to as "wobbling revolution". That is, when the rotator 20 revolves about the central axis C2 while being tilted with respect to the central axis C2 of the swirling chamber (receiving section) 3, the rotator 20 swings in such a manner that the tip of the reduced diameter portion 21 wobbles about the vicinity of the portion where the reduced diameter portion 21 is in contact with the opening 4. Hence, the water discharger 40 fixed to the tip of the reduced diameter portion 21 also undergoes wobbling revolution, integrally with the rotator 20, about the central axis C2 of the swirling chamber (receiving section) 3. In this embodiment, the inflow hole 5, which produces a swirling flow in the swirling chamber (receiving section) 3, serves as a driving mechanism.

When the rotator 20 is undergoing wobbling revolution, part of the outer peripheral surface of the reduced diameter portion 21 is in contact with the inner wall surface of the opening 4, and part of the side surface (peripheral surface) of the large diameter portion 22 is in contact with the guiding surface 3*a* of the swirling chamber (receiving section) 3. Hence, the kinetic frictional force occurring at these contact portions acts on the rotator 20. This kinetic frictional force allows the rotator 20 to undergo wobbling revolution while rolling on the inner wall surface of the opening 4 and the guiding surface 3*a*, as opposed to sliding in the swirling chamber (receiving section) 3 while being in contact with the opening 4 and the guiding surface 3*a* with the contact site left unchanged. That the rotator 20 rolls on the inner wall surface of the opening 4 and the guiding surface 3*a* means that the rotator 20 rotates about its own central axis C1.

That is, the rotator 20 undergoes wobbling revolution about the central axis C2 of the swirling chamber (receiving section) 3 while rotating about its own central axis C1. The revolution direction of the rotator 20 about the central axis C2 of the swirling chamber (receiving section) 3 (the direction of arrow A in FIG. 2) is the same as the swirling direction of the swirling flow formed in the swirling chamber (receiving section) 3, and the rotation direction (the direction of arrow B in FIG. 2) of the rotator 20 about its own central axis C1 is opposite to the revolution direction A. With regard to this rotation, the rotation direction and the number of rotations can be controlled illustratively by the kinetic friction coefficient of the contact surface, the material and shape of the large diameter portion 22 of the rotator 20, the inflow velocity from the inflow hole 5, the gap between the swirling chamber (receiving section) 3 and the large diameter portion 22.

Part of the water poured into the swirling chamber (receiving section) 3 flows into the rotator 20 from the opening 24 at the end of the rotator 20 on the large diameter portion 22 side and from the through holes 23 formed in the side surface thereof, and flows toward the tip of the reduced diameter portion 21 in the axial direction of the rotator 20. Then, the water poured out of the tip of the reduced diameter portion 21 flows into the decelerating section (storage chamber) 43 inside the water discharger 40. When the water in the swirling chamber (receiving section) 3 flows into the rotator 20 and flows inside the rotator 20, it still has a swirling component. Furthermore, when it flows through the reduced diameter portion 21, which is a relatively narrow channel, the flow velocity increases.

The decelerating section (storage chamber) 43 is formed in the space inside the storage member 41, which has a flattened shape having a larger radial dimension than the swirling chamber (receiving section) 3 and the rotator 20. Hence, the decelerating section (storage chamber) 43 has an area larger than the cross-sectional area of the coupling section, and the force of the water flowing in from the tip of the reduced diameter portion 21 can be decreased. Furthermore, the cross-sectional area of the aforementioned coupling section 25 is smaller than the cross-sectional area of the inflow port 42 in the water discharger upstream of the decelerating section (storage chamber) 43. Hence, the force of the water flowing in from the tip of the reduced diameter portion 21 can be reliably decreased. That is, simply by temporarily storing water in the decelerating section (storage chamber) 43 without addition of a special mechanism or component, the flow velocity of the water can be significantly decreased, and the swirling component can be eliminated.

The water thus flow-regulated in the decelerating section (storage chamber) 43 is discharged outside like a shower from the plurality of water discharge ports 45 communicating with the decelerating section (storage chamber) 43. Furthermore, the plurality of water discharge ports 45 have a smaller total cross-sectional area than the decelerating section (storage chamber) 43. Hence, the water decelerated by the decelerating section (storage chamber) 43 with the swirling component lost can be accelerated and discharged. Furthermore, because the water discharge ports 45 are tilted with respect to the central axis C1 of the rotator 20, the water free from the swirling component can be discharged in a tilted direction.

The rotator 20 and the water discharger 40 undergo a combined motion of wobbling revolution and rotation as described above. Hence, the water discharge trajectory (e.g., the trajectory along which the impact site of the water discharge flow to the human body or the like travels on the human body surface) is a combination of the trajectory resulting from rotation and the trajectory resulting from wobbling revolution.

Figure 4:
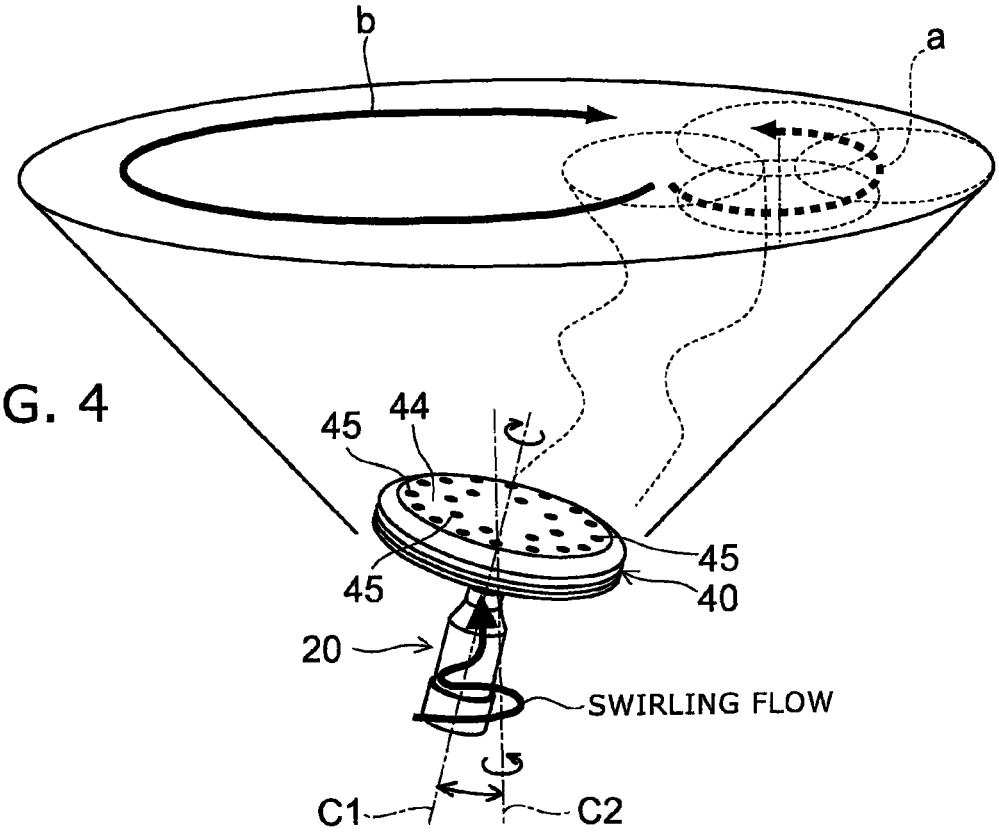
FIG. 4 is a schematic view for describing behavior of a water discharge flow discharged from the shower device according to the example of the invention.

FIG. 4 schematically shows the water discharge trajectory. In FIG. 4, the shower device is shown only in the rotator 20 and the water discharger 40, which are movable portions, and the guiding member 1 provided with the swirling chamber (receiving section) 3 is not shown.

The integrated rotation of the rotator 20 and the water discharger 40 about their central axis C1 forms a water discharge flow traveling along a circular trajectory as shown by the solid line in FIG. 4 in the direction b which is the same as the rotation direction. Here, because the water discharge ports 45 are tilted with respect to the central axis C1 of the rotator 20, the water discharge flow travels along a circle having a larger diameter than the sprinkler plate 44 provided with the water discharge ports 45.

Here, as a comparative example, if a plurality of water discharge ports 45 are tilted in a symmetric relation to the central axis C1, or all the water discharge ports 45 are parallel to the central axis C1 of the rotator 20, then a water discharge flow having a symmetric spreading with respect to the central axis C1 is discharged, and continues to hit the same site on the human body or the like even if the rotator 20 and the water discharger 40 rotate about the central axis C1.

In contrast, in this embodiment, a plurality of water discharge ports 45 are tilted in an asymmetric relation to the central axis C1. Hence, a water discharge flow having an asymmetric spreading with respect to the central axis C1 is discharged. With the rotation of the rotator 20 and the water discharger 40 about the central axis C1, the site on the human body or the like hit by the water discharge flow travels about the central axis C1. Thus, the water discharge flow can be showered in a relatively wide region.

The statement that a plurality of water discharge ports 45 are tilted in an asymmetric relation to the central axis C1 includes not only the case where all the water discharge ports 45 are tilted in the same direction, but also a structure in which at least one water discharge port 45 is tilted in a different direction than the other water discharge ports 45. However, if the plurality of water discharge ports 45 have different tilt directions, the impact spots of the water discharge flow are likely to disperse, and it is difficult to provide a feeling of being evenly hit by the water discharge flow in a plane (a feeling of coherence of the water discharge flow).

In contrast, if all the water discharge ports 45 are tilted in the same direction, water discharge flows from the respective water discharge ports 45 travel in the same direction, and hence do not disperse. Thus, the user can bathe a water discharge flow having an even in-plane distribution and a feeling of coherence, and can evenly wash and warm the portion hit by the water discharge flow. Furthermore, reducing the dispersion of the water discharge flow leads to preventing the heat of the water discharge flow from escaping into the air to reduce the temperature decrease of the water discharge flow during flight.

The water poured into the swirling chamber (receiving section) 3 not only serves to swirl and cause the rotator 20 to undergo rotation and wobbling revolution, but also serves in itself as a water discharge flow passing through the rotator 20 and the water discharger 40 and discharged from the water discharge ports 45. Here, if the water reaches the water discharge ports 45 with the swirling component, it is discharged dispersively in directions other than the tilt direction of the water discharge ports 45, and the water discharge flow is likely to have an uneven in-plane distribution without a feeling of coherence.

In this regard, in this embodiment, a decelerating section (storage chamber) 43 is provided between the rotator 20 and the sprinkler plate 44, and the water is temporarily stored in the decelerating section (storage chamber) 43. Thus, the flow velocity of the water can be significantly decreased, and the swirling component can be eliminated. Because the water passing through the water discharge ports 45 loses the swirling component, it can be reliably discharged in the tilt direction of the water discharge ports 45, and provide a water discharge flow having an even in-plane distribution and a feeling of coherence with reduced dispersion.

For instance, if the water discharge ports 45 are formed in the vicinity of the center of the sprinkler plate 44, the water poured out of the tip of the rotator 20 may fail to be subjected to sufficient flow regulation in the decelerating section (storage chamber) 43 and flow into the water discharge ports 45 with the swirling component. Hence, the water discharge ports 45 are formed preferably in the outer peripheral portion of the sprinkler plate 44. Furthermore, if the water discharge ports 45 are formed in the outer peripheral portion of the sprinkler plate 44, the water discharge flow can be discharged in a wider region by the centrifugal force generated by the aforementioned rotation and wobbling revolution.

Furthermore, in this embodiment, the wobbling revolution of the rotator 20 and the water discharger 40 about the central axis C2 of the swirling chamber (receiving section) 3 forms a water discharge flow traveling in a relatively narrow region as shown by dotted lines in FIG. 4. The rotation angle determined by the tilt of the water discharge ports 45 is set to be larger than the revolution angle defined by the rotator 20 and the guiding surface 3*a*. Hence, this water discharge flow formed by wobbling revolution travels in the direction a, which is opposite to the traveling direction b of the water discharge flow formed by rotation, in a narrower region than the traveling region of the water discharge flow formed by rotation and faster than the travel in the direction b. Hence, as a whole, while traveling fast in a relatively narrow region in the direction of arrow a in FIG. 4, the water discharge flow travels slowly in the direction b opposite to the direction a in a region larger than that traveling direction.

The water discharge flow formed by wobbling revolution can cover a more inside region which cannot be covered by only the water discharge flow formed by rotation. Hence, an even, planar water discharge flow can be obtained without the so-called central void. Thus, this embodiment can realize a shower-like water discharge flow which planarly covers a wider region without central void. A plurality of such shower devices according to this embodiment can be attached to the wall of a bathroom or shower booth, for instance, and the user can bathe water discharge flows from the shower devices. Then, a wide region of the body can be evenly warmed at a time in a hands-free manner, and a sufficient feeling of bathing can be achieved simply by the water discharge flows. In contrast to bathing in a bathtub, such shower bathing is safe particularly for small children and the elderly because it has no concern about the feeling of pressure due to the water pressure on the body (burden on the heart and lungs) and about drowning.

In the wobbling revolution of the rotator 20 and the water discharger 40, the rotator 20 and the water discharger 40 wobble (swing) about the vicinity of the contact portion of the reduced diameter portion 21 and the opening 4. At this time, to efficiently and reliably cause the wobbling (swinging) of the rotator 20 and the water discharger 40 by reducing the moment of inertia, the center of gravity of the rotator 20 and the water discharger 40 considered as an integrated unit is preferably located in the vicinity of the contact portion of the reduced diameter portion 21 and the opening 4, which serves as the center of wobbling (swinging). Furthermore, the rotator 20 is rotated by kinetic friction due to the centrifugal force of the wobbling (revolution). Hence, the center of gravity of the rotator 20 and the water discharger 40 considered as an integrated unit is preferably located in air outside the opening 4, where they are less susceptible to the effect of buoyancy. This facilitates rotation with a low flow rate, and the user can bathe a comfortable water discharge flow with a low flow rate.

Moreover, the water discharger 40 is formed into a flattened shape to discharge water in a wider region, and the rotator 20 is elongated in the direction of its central axis C1 to reliably receive the force of the swirling flow.

For the rotator 20 to rotate when tilted, contact only needs to be established at least between the outer peripheral surface of the reduced diameter portion 21 and the inner wall surface of the opening 4. However, for more reliable rotation, preferably, the large diameter portion 22 is also brought into contact with the inner wall surface (guiding surface 3*a*) of the swirling chamber (receiving section) 3 so as to increase the frictional force at the contact portion of the rotator 20 and the guiding member 1.

Figure 5:
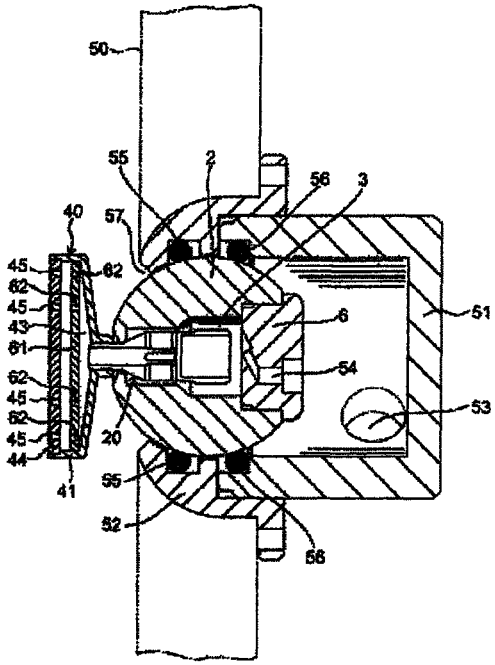
FIG. 5 is a schematic cross-sectional view of a shower device according to an embodiment of the invention.

FIG. 5 is a schematic cross-sectional view of a shower device according to an embodiment of the invention. The same components as those in the above embodiment of the invention are labeled with like reference numerals, and the detailed description thereof is omitted.

In this embodiment, the spherical section 2 is held in the wall 50 of a bathroom or shower booth, for instance, via holding members 51, 52. A seal ring 55 is interposed between the outer peripheral surface of the spherical section 2 and the holding member 52, and a seal ring 56 is interposed between the outer peripheral surface of the spherical section 2 and the holding member 51, so that the spherical section 2 can rotationally move in vertical, horizontal, or oblique directions, liquid-tight to the holding members 51, 52. By the rotational movement of the spherical section 2, the direction which the surface portion of the sprinkler plate 44 faces can be changed, and the water discharge direction of the water discharge flow discharged from the water discharge ports 45 formed in the sprinkler plate 44 can be adjusted.

The water guided along a piping or the like, not shown, flows into the holding member 51 from an inflow hole 53 formed in the holding member 51, and further flows into an inflow hole 54 formed in the sealing member 6. In the inflow hole 54 formed in the sealing member 6, the downstream side communicating with the swirling chamber (receiving section) 3 is tilted with respect to the central axis of the swirling chamber (receiving section) 3. Hence, the water passed through the inflow hole 54 flows into the swirling chamber (receiving section) 3 along the tangential direction and forms a swirling flow in the swirling chamber (receiving section) 3.

In this embodiment, a buffer plate 61 (flow regulating mechanism) spaced from the sprinkler plate 44 is provided on the backside of the sprinkler plate 44 in the decelerating section (storage chamber) 43. That is, a gap is formed between the sprinkler plate 44 and the buffer plate 61. The buffer plate 61 is provided with through holes 62 corresponding to the water discharge ports 45 formed in the sprinkler plate 44. The opening position of each through hole 62 is substantially matched with the upstream side of the corresponding water discharge port 45. The axial direction of the through hole 62 is not tilted, but is generally parallel to the central axis of the rotator 20.

Figure 6:
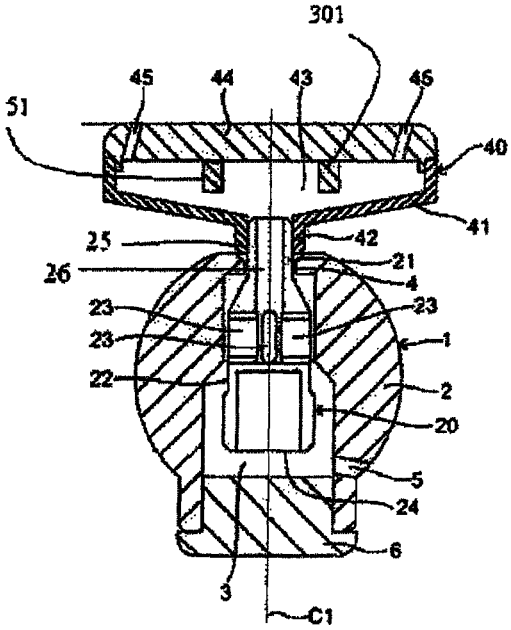
FIG. 6 is a schematic cross-sectional view of a shower device according to an embodiment of the invention.

The water poured from the tip of the rotator 20 into the decelerating section (storage chamber) 43 passes through the through holes 62 formed in the buffer plate 61 before reaching the water discharge ports 45. This structure increases resistance for the water flowing out of the tip of the rotator 20 toward the water discharge ports 45. Thus, in particular, even for a high flow rate, the swirling component is eliminated so that water can be discharged smoothly without disturbance along the tilt direction of the water discharge ports 45. That is, the flow regulating mechanism serves to block the flow of the water with a swirling component poured into the decelerating section to eliminate the swirling component. FIG. 6 is a schematic cross-sectional view of a shower device according to an embodiment of the invention.

In this embodiment, a protruding annular wall 301 (flow regulating mechanism) extending to the upstream side of water is provided on the backside of the sprinkler plate 44 in the decelerating section (storage chamber) 43. Here, the flow regulating mechanism refers to a mechanism serving to block the flow of the water with a swirling component poured into the decelerating section to eliminate the swirling component. The outer wall 51 of the annular wall 301 is formed with a smaller circumference than the arrangement of the water discharge ports 45. Furthermore, the axial direction of the annular wall 301 is not tilted, but is generally parallel to the central axis of the rotator 20.

The water poured from the tip of the rotator 20 into the decelerating section (storage chamber) 43 passes through the inside of the annular wall 301 before reaching the water discharge ports 45. Thus, the water poured out of the tip of the rotator 20 toward the water discharge ports 45 travels toward the water discharge ports 45 after encountering the resistance of the annular wall 301. Hence, in particular, even for a high flow rate, the swirling component is eliminated so that water can be discharged smoothly without disturbance along the tilt direction of the water discharge ports 45.

Figure 7:
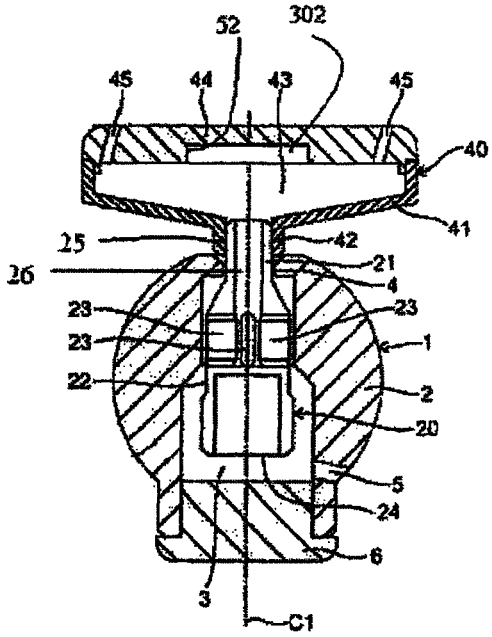
FIG. 7 is a schematic cross-sectional view of a shower device according to an embodiment of the invention.

FIG. 7 is a schematic cross-sectional view of a shower device according to an embodiment of the invention.

In this embodiment, a recess 302 (flow regulating mechanism) set back to the downstream side of water is provided on the backside of the sprinkler plate 44 in the decelerating section (storage chamber) 43. The inner wall 52 of the recess 302 is formed with a smaller circumference than the arrangement of the water discharge ports 45. Furthermore, the axial direction of the recess 302 is not tilted, but is generally parallel to the central axis of the rotator 20.

The water poured from the tip of the rotator 20 into the decelerating section (storage chamber) 43 passes through the inside of the recess 302 before reaching the water discharge ports 45. Thus, the water poured out of the tip of the rotator 20 toward the water discharge ports 45 travels toward the water discharge ports 45 after encountering the resistance of the inside of the recess. Hence, in particular, even for a high flow rate, the swirling component is eliminated so that water can be discharged smoothly without disturbance along the tilt direction of the water discharge ports 45.

Figure 8A:
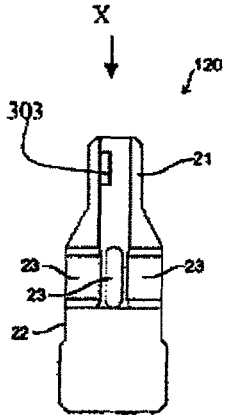
FIGS. 8A and 8B are schematic views showing a rotator included in a shower device according to an embodiment of the invention.
Figure 8B:
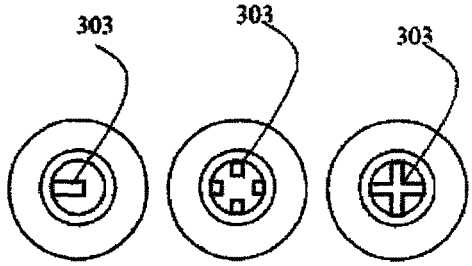

FIG. 8 is a schematic view showing a rotator included in a shower device according to an embodiment of the invention. Here, FIG. 8A is a schematic side view of the rotator included in the shower device according to the embodiment of the invention as viewed from its side surface, and FIG. 8B shows a schematic plan view of the rotator in FIG. 8A as viewed in the direction of arrow X, and a schematic plan view of variations.

In this embodiment, even if no flow regulating mechanism is provided in the decelerating section (storage chamber) 43, a similar effect is achieved by providing a flow regulating mechanism in the channel of the rotator 20 upstream of the tip of the coupling section. The flow regulating mechanism in the channel of the rotator 20 upstream of the tip of the coupling section includes a slit-shaped plate 303 in the channel. This slit-shaped plate 303 is provided so as to extend from the wall surface of the channel of the rotator 20.

The water poured into the rotator 20 flows into the revolving rotator 20 and is given a swirling component. Furthermore, the water having the swirling component passes along the slit-shaped plate 303 provided in the channel of the rotator 20 having a small diameter. Hence, the water poured out of the tip of the coupling section toward the water discharge ports 45 passes through the decelerating section (storage chamber) 43 with the swirling component eliminated by the resistance of the slit-shaped plate 303, and travels toward the water discharge ports 45. Hence, in particular, even for a high flow rate, the swirling component is eliminated so that water can be discharged smoothly without disturbance along the tilt direction of the water discharge ports 45. Furthermore, the slit-shaped plate 303 can achieve a similar effect also when it is provided in a plurality or in a crossed configuration as shown in the variations of FIG. 8B.

Next, an embodiment of the invention will now be described with reference to the drawings. The same components as those in the above embodiment of the invention are labeled with like reference numerals, and the detailed description thereof is omitted.

The Figures are a schematic view illustrating a shower device according to an embodiment of the invention.

Figure 9:
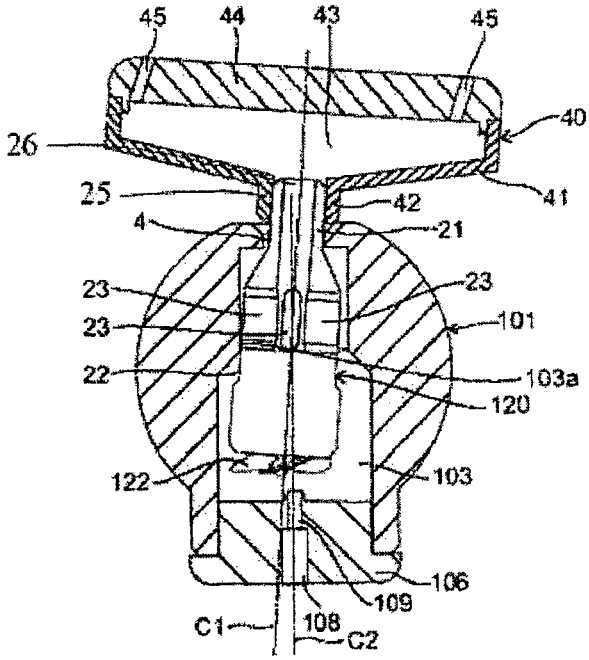
FIG. 9 is a schematic view illustrating a shower device according to an embodiment of the invention.
Figure 10A:
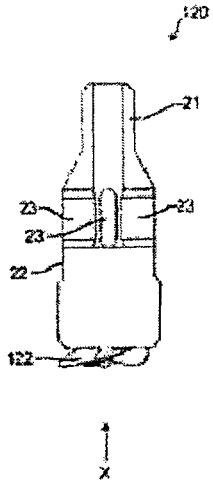
FIGS. 10A and 10B are schematic views showing a rotator included in the shower device according to this embodiment of the invention.
Figure 10B:
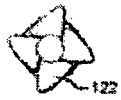

FIG. 9 is a schematic view showing a rotator included in the shower device according to this embodiment. Here, FIG. 10A is a schematic side view of the rotator included in the shower device according to this embodiment as viewed from its side surface, and FIG. 10B shows a schematic plan view of the cylindrical body in FIG. 10A as viewed in the direction of arrow X.

The shower device according to this embodiment provides energy for causing the wobbling revolution and rotation of the rotator directly from fluid (water) to the rotator. The water passes through an inflow hole 109 formed in a sealing member 106 and flows into a rotation chamber (receiving section) 103, which is cylindrically formed inside a guiding member 101 to allow water to flow therein. Hence, the rotation chamber (receiving section) 103 does not include an inflow hole 5 as in the swirling chamber (receiving section) 3 shown in FIG. 1. The inflow hole 109 is connected to the center of the rotation chamber (receiving section) 103. Furthermore, the passage cross-sectional area of the inflow hole 109 is smaller than the passage cross-sectional area of the passage 108 for guiding fluid to the rotation chamber (receiving section) 103. Hence, the flow velocity of the water flowing into the rotation chamber (receiving section) 103 can be increased.

As shown in FIG. 10, the rotator 120 included in the shower device according to this embodiment is formed into a generally bottle-like shape having a reduced diameter portion 21 and a large diameter portion 22, like the rotator 20 shown in FIG. 1. The large diameter portion 22 side of this rotator 120 is not opened. Hence, in this embodiment, the water poured into the rotation chamber (receiving section) 103 can be guided into the rotator 120 through through holes 23 and flow out of the tip of the reduced diameter portion 21.

The water poured out of the tip of the reduced diameter portion 21 flows into a decelerating section (storage chamber) 43 inside a water discharger 40. The decelerating section (storage chamber) 43 is a flattened space having a larger radial dimension than the rotation chamber (receiving section) 103 and the rotator 120, and hence has an area larger than the cross-sectional area of the coupling section. Thus, the force of the water flowing in from the tip of the reduced diameter portion 21 can be decreased. That is, simply by temporarily storing water in the decelerating section (storage chamber) 43 without addition of a special mechanism or component, the flow velocity of the water can be significantly decreased, and the swirling component can be eliminated. The water thus flow-regulated in the decelerating section (storage chamber) 43 is discharged outside like a shower from a plurality of water discharge ports 45 communicating with the decelerating section (storage chamber) 43. Furthermore, the plurality of water discharge ports 45 have a smaller total cross-sectional area than the decelerating section (storage chamber) 43. Hence, the water decelerated by the decelerating section (storage chamber) 43 with the swirling component lost can be accelerated and discharged. Furthermore, because the water discharge ports 45 are tilted with respect to the central axis C1 of the rotator 20, the water free from the swirling component can be discharged in a tilted direction.

Furthermore, the rotator 120 includes an axial flow impeller 122 at the lower end of the large diameter portion 22. This axial flow impeller 122 directly receives the flow of the water poured from the inflow hole 109 into the rotation chamber (receiving section) 103 and turns it to a driving force of the rotator 120. Because the water flows from the inflow hole 109 having a small diameter into the rotation chamber (receiving section) 103, it impinges on the axial flow impeller 122 with a high flow velocity. Hence, the rotator 120 revolves in response to a large driving force, and rotates about the central axis C1 of the rotator 120 itself by a frictional force generated on the rotator 120. The combination of the inflow hole 109 for guiding water into the rotation chamber (receiving section) 103, and the axial flow impeller 122 provided on the rotator 120, is referred to as a driving mechanism. The rest of the structure is the same as the structure of the shower device described above with reference to FIGS. 1 to 4.

The behavior of this rotator 120 is described in more detail. When water is supplied from the inflow hole 109 to the rotation chamber (receiving section) 103, the internal pressure of the rotation chamber (receiving section) 103 increases. Thus, part of the outer peripheral surface of the reduced diameter portion 21 is pressed to the inner wall surface of the opening 4, and part of the side surface (peripheral surface) of the large diameter portion 22 is pressed to the guiding surface 103*a* of the rotation chamber (receiving section) 103. Because the axial flow impeller 122 turns the flow of water into the rotation chamber (receiving section) 103 to a driving force, the rotator 120 undergoes wobbling revolution about the central axis C2 of the rotation chamber (receiving section) 103 in response to this driving force. Such revolution generates a frictional force at the contact portion of the reduced diameter portion 21 and the opening 4 and at the contact portion of the large diameter portion 22 and the rotation chamber (receiving section) 103. In response to this frictional force, the rotator 120 starts to rotate about the central axis C1 of the rotator 120 itself in the rotation chamber (receiving section) 103.

Like the shower device according to this embodiment, also in the case where, as opposed to the swirling flow, the axial flow impeller 122 turns the flow of water into the rotation chamber (receiving section) 103 to a driving force, the water discharge flow formed by wobbling revolution can cover a more inside region which cannot be covered by only the water discharge flow formed by rotation. Hence, an even, planar water discharge flow can be obtained without the so-called central void. Thus, this embodiment can also realize a shower-like water discharge flow which planarly covers a wider region without central void. Furthermore, a plurality of water discharge ports 45 are tilted in an asymmetric relation to the central axis C1. Hence, as described above with reference to FIG. 3, a water discharge flow having an asymmetric spreading with respect to the central axis C1 is discharged. With the rotation of the rotator 120 and the water discharger 40 about the central axis C1, the site on the human body or the like hit by the water discharge flow travels about the central axis C1. Thus, the water discharge flow can be showered in a relatively wide region.

Figure 11:
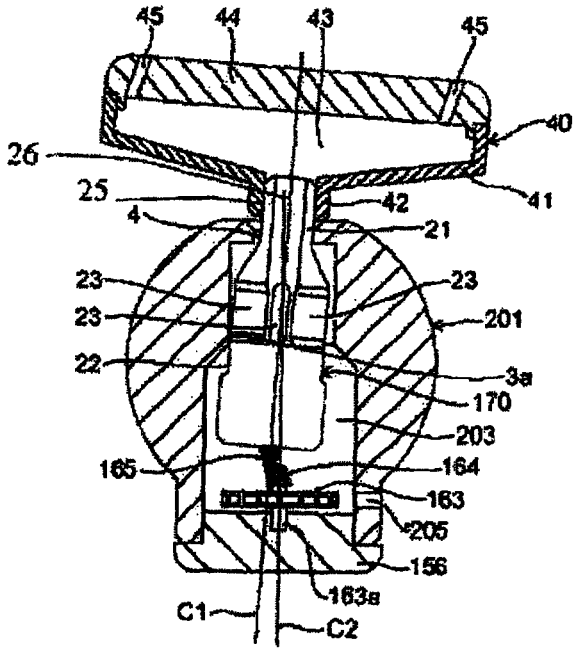
FIG. 11 is a schematic view illustrating a shower device according to an embodiment of the invention.

FIG. 11 is a schematic view illustrating a shower device according to an embodiment of the invention.

In the shower device according to this embodiment, a waterwheel and a gear are driven by a water flow to cause the wobbling revolution and rotation of the rotator. Thus, the shower device according to this embodiment provides energy for causing the wobbling revolution and rotation of the rotator directly from fluid (water) to the rotator. The shower device according to this embodiment includes a rotation chamber (receiving section) 203, which is cylindrically formed inside a guiding member 201 to allow water to flow therein. The water passes through an inflow hole 205 formed in the rotation chamber (receiving section) 203 and flows into the rotation chamber (receiving section) 203. The inflow hole 205 may be tilted like the inflow hole 5 shown in FIG. 1.

As shown in FIG. 10, the rotator 170 included in the shower device according to this embodiment is formed into a generally bottle-like shape having a reduced diameter portion 21 in the coupling section and a large diameter portion 22, like the rotator 20 shown in FIG. 1. The large diameter portion 22 side of this rotator 170 is not opened. Hence, in this embodiment, the water poured into the rotation chamber (receiving section) 203 can be guided into the rotator 170 through through holes 23 and flow out of the tip of the reduced diameter portion 21.

An impeller wheel 163 is provided in the lower portion of the rotation chamber (receiving section) 203 (above the sealing member 156) so as to be rotatable about the central axis C2 of the rotation chamber (receiving section) 203. This impeller wheel 163 is rotationally driven directly by the flow of the water poured from the inflow hole 205 into the rotation chamber (receiving section) 203. On the impeller wheel 163, a gear 164 is provided via a shaft 163*a* so as to be rotatable about the central axis C2. This gear 164 is driven in synchronization with the rotary drive of the impeller wheel 163. The gear 164 is engaged with gear teeth 165 provided at the lower end of the large diameter portion 22 of the rotator 170.

The rotator 170 is engaged by the gear 164 provided in the lower portion of the rotation chamber (receiving section) 203 and the gear teeth 165 provided at the lower end of the large diameter portion 22 of the rotator 170, and is driven by receiving at the impeller wheel 163 the flow of the water poured from the inflow hole 205 into the rotation chamber (receiving section) 203. Thus, upon rotation of the impeller wheel 163, the rotation about the central axis C2 is transmitted to the rotator 170 eccentrically from the central axis C2 of the rotation chamber (receiving section) 203. Here, because the rotator 170 is tilted by a prescribed tilt angle from the central axis C2, the rotator 170 undergoes wobbling revolution at this prescribed tilt angle.

During such wobbling revolution, the engagement of the gear teeth 165 with the gear 164 causes the rotator 170 to rotate about the central axis C1 of the rotator 170 itself. Hence, the shower device according to this embodiment can rotate the rotator 170 about the central axis C1 of the rotator 170 itself while causing the rotator 170 to undergo wobbling revolution about the central axis C2, thereby pouring water out of the tip of the reduced diameter portion 21. The combination of the inflow hole 205 for guiding water into the rotation chamber, the impeller wheel 163 provided in the rotation chamber (receiving section) 203, the gear 164 coupled to the impeller wheel 163, and the gear teeth 165 provided on the rotator 170 so as to engage with the gear 164, is referred to as a driving mechanism. The rest of the structure is the same as the structure of the shower device described above with reference to FIGS. 1 to 4.

Like the shower device according to this embodiment, also in the case where, as opposed to the swirling flow, the driving force of the impeller wheel 163 directly receiving the flow of the water poured from the inflow hole 205 into the rotation chamber (receiving section) 203 is transmitted via the gear 164 to cause the wobbling revolution and rotation of the rotator 170, the water discharge flow formed by wobbling revolution can cover a more inside region which cannot be covered by only the water discharge flow formed by rotation, as described above with reference to FIGS. 9 and 10. Hence, an even, planar water discharge flow can be obtained without the so-called central void. Furthermore, a plurality of water discharge ports 45 are tilted in an asymmetric relation to the central axis C1. Hence, an effect similar to the effect described above with reference to FIGS. 9 and 10 can be achieved.

Figure 12:
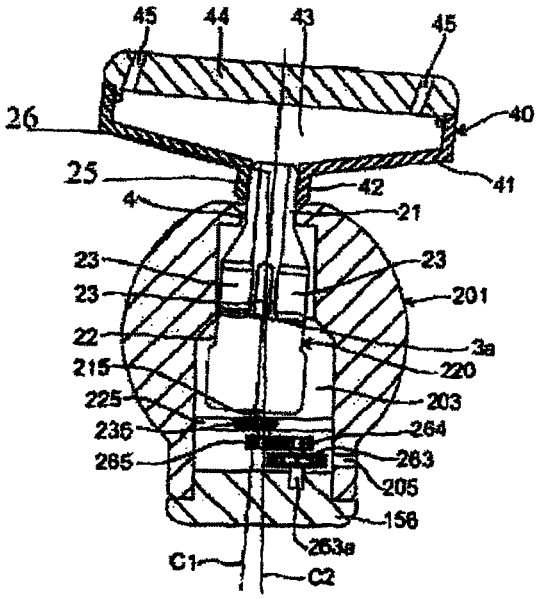
FIG. 12 is a schematic view illustrating a shower device according to an embodiment of the invention.

FIG. 12 is a schematic view illustrating a shower device according to an embodiment of the invention. In the shower device according to this embodiment, a waterwheel and a gear are driven by a water flow to cause the wobbling revolution and rotation of the rotator. Thus, the shower device according to this embodiment provides energy for causing the wobbling revolution and rotation of the rotator directly from fluid (water) to the rotator. The shower device according to this embodiment includes a rotation chamber (receiving section) 203, which is cylindrically formed inside a guiding member 201 to allow water to flow therein. The water passes through an inflow hole 205 formed in the rotation chamber (receiving section) 203 and flows into the rotation chamber (receiving section) 203. The inflow hole 205 may be tilted like the inflow hole 5 shown in FIG. 1.

As shown in FIG. 11, the rotator 220 included in the shower device according to this embodiment is formed into a generally bottle-like shape having a reduced diameter portion 21 in the coupling section and a large diameter portion 22, like the rotator 20 shown in FIG. 1. The large diameter portion 22 side of this rotator 220 is not opened. Hence, in this embodiment, the water poured into the rotation chamber (receiving section) 203 can be guided into the rotator 220 through through holes 23 and flow out of the tip of the reduced diameter portion 21.

An impeller wheel 263 is rotatably provided in the lower portion of the rotation chamber (receiving section) 203 (above the sealing member 156) at a position eccentric from the central axis C2 of the rotation chamber (receiving section) 203. This impeller wheel 263 is rotationally driven directly by the flow of the water poured from the inflow hole 205 into the rotation chamber (receiving section) 203. On the impeller wheel 263, a gear 264 is provided via a shaft 263*a* so as to be rotatable about the central axis of the impeller wheel 263 located at an eccentric position. This gear 264 is driven in synchronization with the rotary drive of the impeller wheel 263.

A transmission disc 225 provided with gear teeth 265 is provided so as to be rotatable about the central axis C2 by engagement with the gear teeth 265 and the gear 264. Furthermore, the transmission disc 225 is provided with a support portion 235 at a position eccentric from the central axis C2, and a transmission shaft 215 provided at the lower end of the large diameter portion 22 of the rotator 220 is rotatably engaged with the support portion 235. The transmission disc 225 is driven by receiving at the impeller wheel 263 the flow of the water poured from the inflow hole 205 into the rotation chamber (receiving section) 203. Thus, upon rotation of the impeller wheel 263, the rotation about the central axis C2 is transmitted to the rotator 220 eccentrically from the central axis C2 of the rotation chamber (receiving section) 203. Here, because the rotator 220 is tilted by a prescribed tilt angle from the central axis C2, the rotator 220 undergoes wobbling revolution at this prescribed tilt angle. During such wobbling revolution, the rotator 220 receives a large driving force, and rotates about the central axis C1 of the rotator 220 itself by a frictional force generated at the contact portion of the rotator 220 and the guiding member 201.

Hence, the shower device according to this embodiment can rotate the rotator 220 about the central axis C1 of the rotator 220 itself while causing the rotator 220 to undergo wobbling revolution about the central axis C2, thereby pouring water out of the tip of the reduced diameter portion 21. The combination of the inflow hole 205 for guiding water into the rotation chamber (receiving section) 203, the impeller wheel 263 provided in the rotation chamber (receiving section) 203, the gear 164 coupled to the impeller wheel 263, and the gear teeth 265 provided on the rotator 220 so as to engage with the gear 264, is referred to as a driving mechanism. The rest of the structure is the same as the structure of the shower device described above with reference to FIGS. 1 to 4.

Like the shower device according to this embodiment, also in the case where, as opposed to the swirling flow, the driving force of the impeller wheel 263 directly receiving the flow of the water poured from the inflow hole 205 into the rotation chamber (receiving section) 203 is transmitted via the gear 264 to cause the wobbling revolution and rotation of the rotator 220, the water discharge flow formed by wobbling revolution can cover a more inside region which cannot be covered by only the water discharge flow formed by rotation, as described above with reference to FIGS. 9 and 10. Hence, an even, planar water discharge flow can be obtained without the so-called central void. Furthermore, a plurality of water discharge ports 45 are tilted in an asymmetric relation to the central axis C1. Hence, an effect similar to the effect described above with reference to FIGS. 9 and 10 can be achieved.

Furthermore, according to an embodiment of the invention, water flows into the revolving rotator in the swirling chamber and the rotation chamber, and hence is given a swirling component. Here, by temporarily storing the water in the decelerating section (storage chamber) 43, the flow velocity of the water can be significantly decreased, and the swirling component can be eliminated. Furthermore, the plurality of water discharge ports 45 have a smaller total cross-sectional area than the decelerating section (storage chamber) 43. Hence, the water decelerated by the decelerating section (storage chamber) 43 with the swirling component lost can be accelerated and discharged.

Furthermore, because the water passing through the water discharge ports 45 loses the swirling component, the water can be discharged smoothly without disturbance along the tilt direction of the water discharge ports 45, and provide a water discharge flow having an even in-plane distribution and a feeling of coherence with reduced dispersion.

Thus, the shower device according to an embodiment of the invention can discharge a planar, shower-like water discharge flow in a wide region while changing the water discharge trajectory.

The shower device according to an embodiment of the invention is also applicable to a toilet bowl with washing functionality, for instance, besides use as a shower device in a bathroom or shower booth.

What is claimed is:

1. A shower device comprising:

a water discharger including a plurality of water discharge ports;

a rotator including a channel at its center;

a coupling section coupling the inside of the water discharger to the channel of the rotator;

a receiving section receiving the rotator;

a driving mechanism configured to rotate and revolve the rotator in the receiving section; and a decelerating section provided inside the water discharger, the water discharger being configured to rotate and revolve by rotation and revolution of the rotator caused by the driving mechanism, the decelerating section having an area larger than a cross-sectional area of the coupling section, the water discharge ports having a smaller total cross-sectional area than the decelerating section so as to accelerate water decelerated by the decelerating section, and the water discharge ports being tilted to a central axis of the rotator, and being provided asymmetrically with respect to the central axis of the rotator.

2. The shower device according to claim 1, wherein the cross-sectional area of the coupling section is smaller than an area of an inflow port in the water discharger.

3. The shower device according to claim 2, further comprising:

a flow regulating mechanism in the decelerating section.

4. The shower device according to claim 3, wherein the driving mechanism includes an inflow hole configured to guide water into the receiving section, a waterwheel provided in the receiving section, a gear coupled to the waterwheel, and a gear teeth provided on the rotator so as to engage with the gear.

5. The shower device according to claim 2, further comprising:

a flow regulating mechanism on upstream side of a tip of the coupling section.

6. The shower device according to claim 5, wherein the driving mechanism includes an inflow hole configured to guide water into the receiving section, a waterwheel provided in the receiving section, a gear coupled to the waterwheel, and a gear teeth provided on the rotator so as to engage with the gear.

7. The shower device according to claim 2, wherein the driving mechanism includes an inflow hole configured to guide water into the receiving section, a waterwheel provided in the receiving section, a gear coupled to the waterwheel, and a gear teeth provided on the rotator so as to engage with the gear.

8. The shower device according to claim 1, further comprising:

a flow regulating mechanism in the decelerating section.

9. The shower device according to claim 8, wherein the driving mechanism includes an inflow hole configured to guide water into the receiving section, a waterwheel provided in the receiving section, a gear coupled to the waterwheel, and a gear teeth provided on the rotator so as to engage with the gear.

10. The shower device according to claim 1, further comprising:

a flow regulating mechanism on upstream side of a tip of the coupling section.

11. The shower device according to claim 10, wherein the driving mechanism includes an inflow hole configured to guide water into the receiving section, a waterwheel provided in the receiving section, a gear coupled to the waterwheel, and a gear teeth provided on the rotator so as to engage with the gear.

12. The shower device according to claim 1, wherein the driving mechanism includes an inflow hole configured to produce a swirling flow in the receiving section.

13. The shower device according to claim 1, wherein the driving mechanism includes an inflow hole configured to guide water into the receiving section, and an impeller wheel provided on the rotator.

14. The shower device according to claim 1, wherein the driving mechanism includes an inflow hole configured to guide water into the receiving section, a waterwheel provided in the receiving section, a gear coupled to the waterwheel, and a gear teeth provided on the rotator so as to engage with the gear.

15. The shower device according to claim 1, wherein the water discharge ports are tilted parallel to each other so that water discharge flows from the water discharge ports travel in a same direction.

* * * * *

UNITED STATES PATENT AND TRADEMARK OFFICE

CERTIFICATE OF CORRECTION

PATENT NO. : 8,720,795 B2
APPLICATION NO. : 12/677156
DATED : May 13, 2014
INVENTOR(S) : Sato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1067 days.

Signed and Sealed this
Twenty-ninth Day of September, 2015

Michelle K. Lee

Michelle K. Lee
*Director of the United States Patent and Trademark Office*